US006344835B1

(12) United States Patent
Allen et al.

(10) Patent No.: US 6,344,835 B1
(45) Date of Patent: Feb. 5, 2002

(54) COMPACTLY STOWABLE THIN CONTINUOUS SURFACE-BASED ANTENNA HAVING RADIAL AND PERIMETER STIFFENERS THAT DEPLOY AND MAINTAIN ANTENNA SURFACE IN PRESCRIBED SURFACE GEOMETRY

(75) Inventors: Bibb B. Allen, Palm Bay; Charles F. Willer, Indialantic; Richard I. Harless, West Melbourne; Rodolfo V. Valentin; Rodney S. Sorrell, both of Melbourne, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/549,371

(22) Filed: Apr. 14, 2000

(51) Int. Cl.[7] ..... H01Q 15/20
(52) U.S. Cl. ..... 343/915; 343/912
(58) Field of Search ..... 343/915, 912, 343/914, 916; 135/29, 31; H01Q 15/20

(56) References Cited

U.S. PATENT DOCUMENTS 3,326,624 A * 6/1967 Maydell et al. ..... 343/915
3,587,098 A * 6/1971 Gosnell ..... 343/915
3,605,107 A * 9/1971 Amboss et al. ..... 343/915
4,683,475 A 7/1987 Luly ..... 343/915
4,926,181 A 5/1990 Stumm ..... 342/5
5,198,832 A 3/1993 Higgins et al. ..... 343/915
5,451,975 A 9/1995 Miller et al. ..... 343/915
5,515,067 A * 5/1996 Rits ..... 343/912
5,574,472 A 11/1996 Robinson ..... 343/915
6,018,328 A 1/2000 Nolan et al. ..... 343/912
6,028,569 A 2/2000 Bassily et al. ..... 343/915

* cited by examiner

*Primary Examiner*—Hoanganh Le
(74) *Attorney, Agent, or Firm*—Allen, Dyer, Doppelt, Milbrath & Gilchrist, P.A.

(57) ABSTRACT

A space deployable antenna reflector surface is formed as a continuous laminate that is shaped to conform with a prescribed energy-focusing surface geometry. The laminate is formed of very thin layers of flexible material, such as very thin sheets of graphite epoxy, containing collapsible radial and perimeter stiffening regions or stiffeners. Due to its thinness, the reflector laminate is collapsible into a folded shape, that facilitates stowage in a restricted volume, such as aboard the space shuttle. The stiffening elements of the laminate antenna structure of the invention facilitate deploying and maintaining the reflector in its intended geometric shape, and collapsing the reflector laminate into a compact serpentine stowed configuration.

13 Claims, 2 Drawing Sheets

COMPACTLY STOWABLE THIN CONTINUOUS SURFACE-BASED ANTENNA HAVING RADIAL AND PERIMETER STIFFENERS THAT DEPLOY AND MAINTAIN ANTENNA SURFACE IN PRESCRIBED SURFACE GEOMETRY

FIELD OF THE INVENTION

The present invention relates to energy-focusing surfaces, such as radio wave antennas, solar concentrators, and the like, and is particularly directed to a compactly stowable antenna reflector that is formed of a thin continuous laminate material containing radial and perimeter stiffening regions or stiffeners. The thinness of the laminate and that of the stiffeners readily allow the reflector to be collapsed into a compact shape that facilitates stowage in a confined volume on board a spacecraft launch vehicle, such as the space shuttle, while also causing the reflector to deploy into and conform with a prescribed energy-focusing surface geometry.

BACKGROUND OF THE INVENTION

The field of deployable platforms, such as space-deployed energy-directing structures, including radio frequency (RF) antennas, solar concentrators, and the like, has matured substantially in the past decade. What was once a difficult art to master has developed into a number of practical applications by commercial enterprises. A significant aspect of this development has been the reliable deployment of a variety of spacecraft-supported antenna systems, similar to that employed by the NASA tracking data and relay satellite (TDRS). Indeed, commercial spacecraft production has now exceeded military/civil applications, so that there is currently a demand for structural systems with proven reliability and performance, and the ever present requirement for "reduced cost." The mission objective for a typical deployable space antenna is to provide reliable RF energy reflection to an energy collector (feed) located at the focus of a prescribed geometry (e.g. parabolic) energy collecting surface.

The current state of parabolic space antenna design is essentially based upon what may be termed a segmented construction approach which, as diagrammatically illustrated in FIGS. 1–4, is configured much like an umbrella. In this type of antenna, a plurality of arcuate segments 1 are connected to a central hub 3, that supports an antenna feed 5. A mechanically advantaged linear actuator (not shown) is used to drive the segments 1 from their stowed or unfurled condition, shown in the side and end views of FIGS. 1 and 2, into a locked, over-driven, position, so as to deploy an Rf reflector surface 7, as shown in the side and end views of FIGS. 3 and 4.

Principal shortcomings of this type of antenna system include the hardware complexity of the antenna reflector, its attendant deployment mechanism, and the considerable stowage volume associated with that structure. As a consequence, new approaches to deployable antenna structures have been sought. The industry desire for these new approaches is based upon the premise that the stowed packaging density for deployable antennas can be significantly increased, while maintaining a deployed reliability that the space community has enjoyed in the past. If the stowed volume can be reduced (and therefore an increase in packaging density for a given weight), launch services can be applied more efficiently.

SUMMARY OF THE INVENTION

In accordance with the present invention, these objectives are successfully achieved by configuring the reflector as a continuous laminate of very thin layers of flexible energy-directing medium or material, having a relatively low coefficient of thermal expansion (CTE), such as thin sheets of graphite epoxy and the like. The flexible laminate is shaped to conform with a prescribed energy-focusing surface geometry (e.g., paraboloid). Because of its thinness, the reflector laminate is has reduced weight and is readily collapsible into a folded shape, that facilitates stowage in a restricted volume. In addition, the laminate structure of the invention includes a plurality of radial and perimeter stiffening regions, that not only function to deploy and maintain the reflector in its intended geometric shape, but are configured to facilitate collapsing the reflector laminate into a compact (serpentine) stowed configuration.

DETAILED DESCRIPTION

For purposes of providing a non-limiting example, the present invention will be described in connection with its application to an RF reflector antenna surface, having a prescribed geometry, such as a parabolic surface of revolution (or paraboloid), commonly employed in the communications industry. It should be observed, however, that the invention is not limited to RF reflector applications or to any particular geometric shape. The collapsible stiffening architecture described and shown herein may also be incorporated into other energy-directing applications, such as but not limited to solar energy collection, including reflection and refraction systems, acoustic energy applications, and the like.

Figure 1:
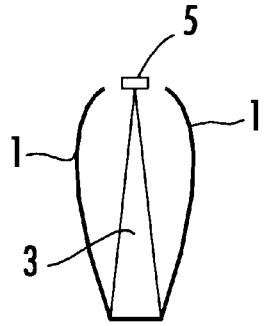
FIG. 1. PRIOR ART
FIGS. 1 and 2 are respective diagrammatic side and end views of the stowed condition of a conventional segmented radial rib-based space-deployable parabolic antenna.
Figure 2:
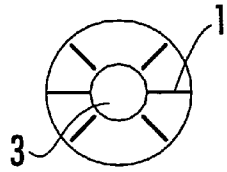
FIG. 2. PRIOR ART
Figure 3:
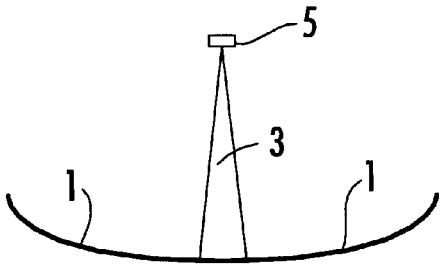
FIG. 3. PRIOR ART
FIGS. 3 and 4 are respective diagrammatic side and end views of the deployed condition of the antenna of FIGS. 1 and 2.
Figure 4:
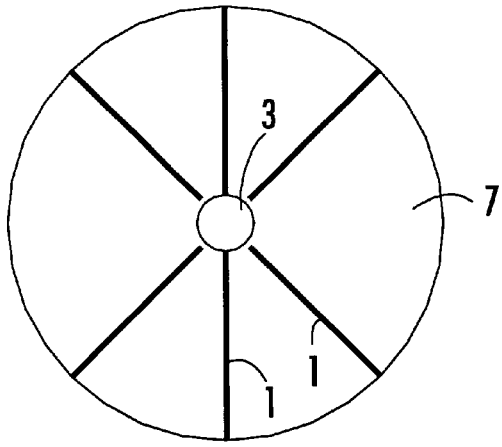
FIG. 4. PRIOR ART
Figure 5:
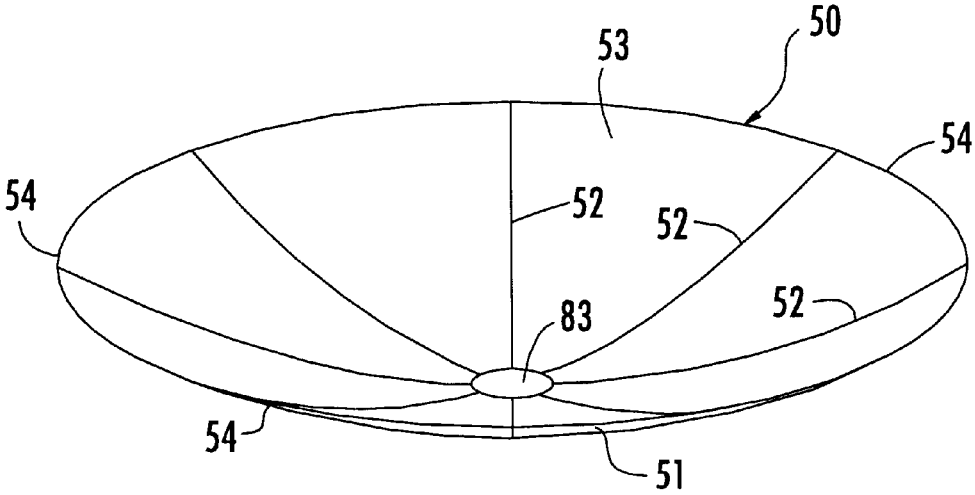
FIG. 5 is a diagrammatic perspective view of applying the invention to a generally parabolic RF antenna reflector surface.

FIG. 5 is a diagrammatic perspective view of applying the invention to a generally parabolic RF antenna reflector surface 50. As described briefly above, the material of the reflector surface 50 is preferably comprised of a continuous laminate of very thin layers of flexible material, that are shaped to conform with a prescribed energy-focusing surface geometry (e.g., a paraboloid in the present embodiment). The layers themselves may be reflective to radio wave waves or the laminate may be coated with an RF reflective material such as a conductive paint. Preferably, the flexible radio wave-reflective or energy-directing material is made of a medium or material having a relatively low coefficient of thermal expansion. As a non-limiting example graphite epoxy may be employed.

Figure 14:
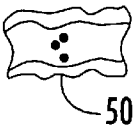
FIG. 14 is a diagrammatic illustration of the layered configuration of a reflector surface.

The reflector surface may be fabricated from thin sheets of graphite epoxy having a relatively small thickness on the order of only several mils, that are built up or layered, as diagrammatically shown in FIG. 14, into a multiply laminate structure having a prescribed compound curve shape and thickness on a precision mold that conforms with the intended geometry of the antenna reflector. Because of its substantial 'thinness', the reflector laminate 50 has substantial flexibility, so that it may be readily collapsed into a relatively compact folded shape, such as a generally cylindrical shape shown at 60 in the diagrammatic perspective In order to deploy and maintain the flexible material of the reflector surface 50 in its intended geometric shape, the laminate structure of the invention includes a distribution of radial stiffeners 52 and perimeter or circumferential stiffeners 54. As shown in the plan view of FIG. 8, the radial stiffeners 52 are located along a plurality of radial lines 81, that extend radially outwardly from a generally central circular aperture 83 to a circumferential perimeter 85 of the antenna surface 50. The radial lines 81 effectively spatially define therebetween a plurality of radially adjoining surface compound curve wedge-shaped segments 82. Although the illustrated example shows eight radial lines, it should be observed that the invention is not limited to this or any particular number of radial stiffeners. The number and size may be tailored to accommodate the physical parameters of the particular antenna design. Similarly, the perimeter stiffeners 54 are located along the outer edge or circumferential perimeter 87 of the antenna surface 50, adjoining termination points of the radial lines 81.

Figure 8:
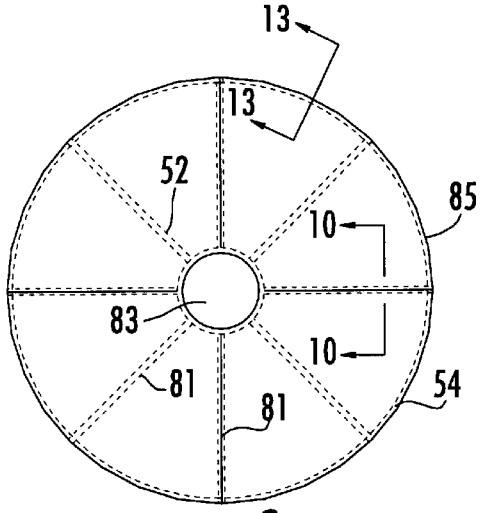
FIG. 8 is a diagrammatic plan view of the antenna of FIG. 5 showing radial stiffeners along a plurality of lines extending radially from a central aperture to a circumferential perimeter.
Figure 9:
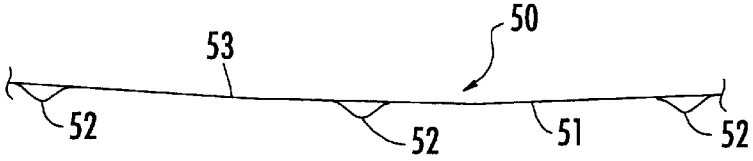
FIG. 9 is an edge view of a portion of the antenna surface of FIG. 5, showing radial stiffeners formed on a rear surface of the laminate.
Figure 10:
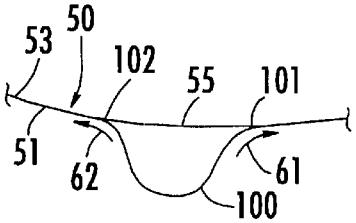
FIG. 10 is a diagrammatic enlarged sectional view taken along section lines 10—10 of FIG. 8.

FIG. 9 is an edge view of a portion of the antenna surface 50, showing radial stiffeners 52 formed on a rear surface 51 of the laminate 50, opposite to a front surface 53 upon which RF energy is incident. As further shown in the diagrammatic enlarged sectional view of FIG. 10, which is taken along section lines 10—10 of FIG. 8, an individual radial stiffener is formed by attaching (for example, by means of a suitable epoxy graphite adhesive) a generally longitudinal strip of flexible material 100 along spaced apart edges 101 and 102 thereof to the back surface 51 of the laminate 50. Each strip of flexible material 100 has an overall transverse surface dimension between attachment locations 101 and 102 that is greater than the distance along the surface 55 of the laminate material 50 between the attachment locations 101 and 102.

This urges the flexible strip 100 into a generally bowed or concave shape, causing the stiffening strip to store tensile forces that tend to spread or deploy the surface 50 in a circumferential direction (as shown by arrows 61 and 62) into its intended compound curve shape. The convexly bowed strip also forms a generally tubular-shaped radial spine or stiffener that imparts a prescribed degree of rigidity to the adjacent surface portion 55 of the antenna laminate surface 50. As a consequence a distribution of such radial stiffeners 100 serves to impart radial stiffness to the antenna surface 50 and thereby maintain the intended compound curve configuration of the antenna surface in its deployed state.

Figure 11:
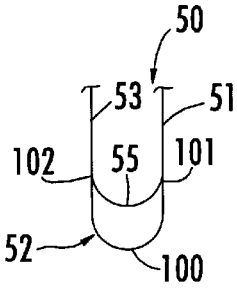
FIG. 11 diagrammatically illustrates trough-shaped nesting of a radial stiffener of the antenna laminate surface of FIG. 5 in its collapsed condition.

The degree of radial stiffness imparted by a radial strip 100 will depend upon the properties of the material of the antenna surface 50 and those of the flexible strip 100, such as but not limited to thickness, width of the strip 100, tensile coefficient, etc. As a non-limiting example, stiffening strip 100 may be made of the same material (e.g., graphite epoxy) and contain multiple, built-up plies of the laminate 50, to realize a prescribed stiffness, while still being sufficiently flexible to allow a trough-shaped nesting of the adjacent surface portion 55 of the antenna laminate surface 50 in its collapsed condition for stowage, as shown in FIG. 11.

Figure 12:
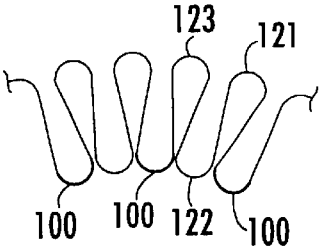
FIG. 12 shows arcuate segments of the antenna surface of FIG. 5 collapsed into a set of 'serpentine' folds between successive radial stiffeners.

As pointed out above, the number and size of radial stiffeners may be tailored to accommodate the physical parameters of the particular antenna design. In this regard, the number of folds to which the antenna surface 50 collapses will depend, in part, on the spatial separation of the radial stiffeners on the rear side 53 of the antenna laminate surface. In the partial end view of the generally cylindrical stowed configuration of the antenna surface of the invention, FIG. 12 shows an example of the manner in which arcuate segments of the antenna surface 50 may be collapsed to nest as a set of meandering, curvilinear or 'serpentine' folds 121, 122 and 123 between successive radial stiffeners 100.

Figure 13:
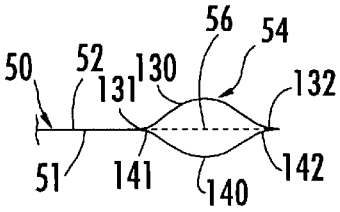
FIG. 13 is a diagrammatic enlarged sectional view taken along lines 13—13 of FIG. 8.

FIG. 13 is a diagrammatic enlarged sectional view taken along lines 13—13 of FIG. 8, showing a respective one of a plurality of perimeter or circumferential stiffening elements 54 that are sequentially distributed along the perimeter 85 of the antenna surface 50. As shown therein, a perimeter stiffening element 54 is comprised of a pair of generally annular shaped strips 130 and 140 of flexible material that are attached together (e.g., by means of a graphite epoxy adhesive) at respective radial interior and exterior side edges 131/141 and 132/142 thereof.

One of the strips (for example, annular strip 130) may comprise the actual material of an annular perimeter region of the antenna surface 50 proper, while the other strip (for example, annular strip 140) may comprise a separate annular section of material. Each flexible annular perimeter strip 130/140 has an overall transverse surface dimension between attachment its locations 131/141 and 132/142 that is greater than the radial separation 56 therebetween along the surface of the laminate material 50, so that each strip 130/140 is bowed into a concave shape that stores tensile forces that tend to deploy and maintain the perimeter 85 of the antenna surface 50 deployed in its intended circular shape.

Like the radial stiffeners 100, the circumferential stiffness imparted by a respective perimeter stiffener 54 will depend upon the properties of the material of the antenna surface 50 and those of the pair of adjoining annular strips 130/140. Each of perimeter strips 130/140 may be made of the same material (e.g., graphite epoxy) and contain multiple, built-up plies of the laminate 50, to realize a prescribed stiffness, while being sufficiently flexible to comply with the above-described serpentine-fold nesting of the antenna laminate surface 50 in its collapsed condition, shown in FIGS. 6 and 7.

As will be appreciated from the foregoing description, the objective of significantly increasing the stowed packaging density of a deployable antenna, while at the same time reliably maintaining its intended deployed geometry reliability may be successfully achieved by configuring the antenna reflector surface as a continuous laminate of very thin layers of low CTE flexible material, such as very thin sheets of graphite epoxy, that are shaped to conform with a prescribed energy-focusing surface geometry (e.g., paraboloid). Because of its thinness, the reflector laminate is collapsible into a folded shape, that facilitates stowage in a restricted volume. In addition, the laminate structure of the invention includes a plurality of radial and perimeter stiffening regions, that not only function to deploy and maintain the reflector in its intended geometric shape, but are configured to facilitate collapsing the reflector laminate into a compact (serpentine) stowed configuration.

While we have shown and described an embodiment in accordance with the present invention, it is to be understood that the same is not limited thereto but is susceptible to numerous changes and modifications as known to a person skilled in the art. We therefore do not wish to be limited to the details shown and described herein, but intend to cover all such changes and modifications as are obvious to one of ordinary skill in the art.

What is claimed is:

1. An apparatus comprising:

a flexible, energy-directing medium having a substantially continuous surface and shaped to conform with a prescribed geometry; and a distribution of plural of layers of flexible material attached with respective portions of the surface of said medium and forming a plurality of collapsible stiffening elements which, in a deployed configuration of said medium, cause said medium to conform with said prescribed geometry and, in a non-deployed configuration of said medium, cause said medium to conform with a stowage configuration, wherein said geometry comprises a surface of revolution, and said plural layers of flexible material include layers of flexible material distributed along radial portions of said surface of revolution, so as to incorporate a plurality of collapsible radial stiffening elements with said flexible, energy-directing medium, and wherein said plural layers of flexible material further include layers of flexible material extending along a perimeter portion of said medium, so as to incorporate a plurality of collapsible circumferential stiffening elements with said perimeter portion of said medium.

2. The apparatus according to claim 1, wherein a respective circumferential stiffening element comprises a perimeter region of said medium and a generally longitudinally extending strip of flexible material attached thereto, each of said perimeter region of said medium and said generally longitudinally extending strip of flexible material having a transverse dimension greater than a width of said circumferential stiffening element, so as to deploy to mutually adjacent convex shapes and stow to a generally trough shape.

3. The apparatus according to claim 1, wherein said medium comprises a flexible laminate of layers of generally continuous web material.

4. An apparatus comprising:

a flexible, energy-directing medium having a substantially continuous surface and shaped to conform with a prescribed geometry; and a distribution of plural of layers of flexible material attached with respective portions of the surface of said medium and forming a plurality of collapsible stiffening elements which, in a deployed configuration of said medium, cause said medium to conform with said prescribed geometry and, in a non-deployed configuration of said medium, cause said medium to conform with a stowage configuration, wherein a respective layer of flexible material and an adjacent portion of said medium form a generally tubular-configured stiffener in said deployed configuration of said medium, and a generally trough-shaped element in said stowage configuration of said medium.

5. The apparatus according to claim 4, wherein said respective layer of flexible material is comprised of the same flexible material as said medium.

6. An apparatus comprising:

a flexible, energy-directing medium having a substantially continuous surface and shaped to conform with a prescribed geometry; and a distribution of plural of layers of flexible material attached with respective portions of the surface of said medium and forming a plurality of collapsible stiffening elements which, in a deployed configuration of said medium, cause said medium to conform with said prescribed geometry and, in a non-deployed configuration of said medium, cause said medium to conform with a stowage configuration, wherein said geometry comprises a surface of revolution, and said plural layers of flexible material include layers of flexible material distributed along radial portions of said surface of revolution, so as to incorporate a plurality of collapsible radial stiffening elements with said flexible, energy-directing medium, wherein a respective layer of flexible material comprises a generally longitudinal strip of flexible material attached to a radial surface portion of said medium in a manner that forms a generally tubular-configured radial stiffener along said radial surface portion of said medium in said deployed configuration thereof, and a generally trough-shaped element in said stowage configuration thereof.

7. An apparatus comprising:

a flexible, energy-directing medium having a substantially continuous surface and shaped to conform with a prescribed geometry; and a distribution of plural of layers of flexible material attached with respective portions of the surface of said medium and forming a plurality of collapsible stiffening elements which, in a deployed configuration of said medium, cause said medium to conform with said prescribed geometry and, in a non-deployed configuration of said medium, cause said medium to conform with a stowage configuration, wherein said geometry comprises a surface of revolution, and said plural layers of flexible material include layers of flexible material distributed along radial portions of said surface of revolution, so as to incorporate a plurality of collapsible radial stiffening elements with said flexible, energy-directing medium, wherein a respective stiffening element comprises a generally longitudinal region of said medium and a generally longitudinally extending strip of flexible material attached thereto, said generally longitudinally extending strip of flexible material having a transverse dimension greater than a width of said stiffening element, so as to deploy to a convex shaped stiffening element and stow to a generally trough shape.

8. The apparatus according to claim 7, wherein each of said medium and said flexible material comprises a generally continuous web material.

9. A deployable radio wave antenna that develops to a prescribed surface of revolution, comprising a flexible, energy-directing material having a substantially continuous surface containing a plurality of radially adjoining arcuate segments, and being shaped to conform with a prescribed energy-directing geometry, a plurality of collapsible radial stiffening elements attached to said flexible, energy-directing material along radial lines between said radially adjoining arcuate segments, a respective radial stiffening element being formed of a generally radial strip of flexible material having a transverse surface dimension greater than a distance between attachment locations thereof to said flexible, energy-directing material, so as to form a generally tubular-configured radial stiffener along a radial line of said flexible, energy-directing material in said deployed configuration thereof, and a generally trough-shaped element in a stowage configuration thereof.

10. The deployable radio wave antenna according to claim 9, wherein said respective radial stiffening element is made of said flexible, energy-directing material.

11. A deployable radio wave antenna according to claim 9, further including a plurality of circumferential stiffening elements located along perimeter portions of said plurality of radially adjoining arcuate segments, a respective circumferential stiffening element comprising a perimeter region of said flexible, energy-directing material, and a generally longitudinally extending strip of flexible material attached thereto, each of said perimeter region of said flexible, energy-directing material and said generally longitudinally extending strip of flexible material having a transverse dimension greater than a width of said circumferential stiffening element, so as to deploy to mutually adjacent convex shapes forming a generally tubular circumferential stiffening element, and stow to a generally trough shape.

12. The deployable radio wave antenna according to claim 9, wherein said flexible, energy-directing material comprises a flexible laminate of layers of generally continuous web material.

13. The deployable radio wave antenna according to claim 9, wherein said respective circumferential stiffening element is made of said flexible, energy-directing material.

* * * * *

UNITED STATES PATENT AND TRADEMARK OFFICE

CERTIFICATE OF CORRECTION

PATENT NO. : 6,344,835 B1 
DATED : February 5, 2002
INVENTOR(S) : Bibb B. Allen, Charles F. Willer, Richard I. Harless, Rodolfo V. Valentin and Rodney S. Sorrell It is certified that error appears in the above-identified patent and that said Letters Patent is hereby corrected as shown below:

Column 1,
Line 48, delete "Rf" insert -- RF --

Column 2,
Line 7, delete "is"

Column 3,
Line 15, delete "multiply" insert -- multi-ply --
Line 22, after: "in the diagrammatic perspective"

Figure 6:
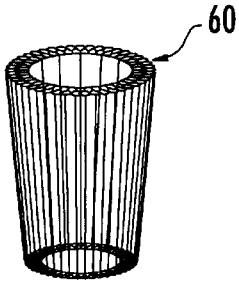
FIGS. 6 and 7 are respective diagrammatic perspective and end views of the antenna surface of FIG. 5 collapsed into a 'serpentine' folded shape.
Figure 7:
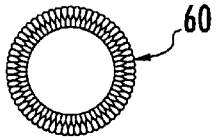

Insert -- view of Figure 6 and the end view of Figure 7, which facilitates stowage within a confined volume on board a spacecraft launch vehicle, such as the space shuttle. In addition the thinness of the reflector laminate substantially reduces its payload weight and thereby cost of launch and deployment. --

Column 4,
Line 41, delete "its"

Column 7,
Line 15, delete "A" insert -- The --

Signed and Sealed this

First Day of October, 2002

*Attest:*

*Attesting Officer*

JAMES E. ROGAN
*Director of the United States Patent and Trademark Office*